United States Patent [19]

Kessler

[11] 4,057,945

[45] Nov. 15, 1977

[54] INSULATING SPACER FOR DOUBLE INSULATED GLASS

[76] Inventor: Gerald Kessler, Box 389, Youngstown, Ohio 44501

[21] Appl. No.: 733,902

[22] Filed: Oct. 19, 1976

[51] Int. Cl.[2] ..... E06B 3/24

[52] U.S. Cl. ..... 52/398; 52/172; 52/616

[58] Field of Search ..... 52/398, 399, 400, 172, 52/616

[56] References Cited

U.S. PATENT DOCUMENTS

| | | | |
|---|---|---|---|
| 3,012,642 | 12/1961 | Emmerich | 52/399 |
| 3,261,139 | 7/1966 | Bond | 52/172 |

FOREIGN PATENT DOCUMENTS

| | | | |
|---|---|---|---|
| 953,159 | 8/1974 | Canada | 52/616 |
| 1,434,283 | 10/1968 | Germany | 52/172 |

*Primary Examiner*—John E. Murtagh
*Attorney, Agent, or Firm*—Browdy and Neimark

[57] ABSTRACT

An improved insulating spacer to reduce the heat transfer between the two panes of glass of double insulated glass comprises an extruded or roll-formed metal spacer together with plastic insulating elements which thermally isolate the metal spacer from the panes of glass while permitting conventional application of the sealant to provide reliable bonding. In one embodiment the plastic insulator comprises an extruded plastic overlay which fits tightly over part of a conventional metal spacer and has projecting contacts which abut the glass. In an alternative design the plastic insulator comprises extruded plastic strips which are attached through grooves in the metal spacer. In both designs the height of the insulating contact element can be selected to correspond to the desired gap width between the two glass plates.

10 Claims, 6 Drawing Figures

INSULATING SPACER FOR DOUBLE INSULATED GLASS

FIELD OF THE INVENTION

The present invention relates to improving thermal insulation between spaced elements and, more particularly, to an improved spacer for double insulated glass with a plastic insulator designed to reduce heat transfer from one pane of glass to the other.

BACKGROUND OF THE INVENTION

A critical requirement in modern building construction is energy conservation. A particular problem in view of the extensive use of glass in modern architecture is a loss of heat from the building through glass surfaces. One solution has been the increased use of insulating glass units comprising basically two glass panels separated by a sealed dry air space. Sealed insulating glass units generally require some means of precisely separating the two glass panels. The spacers currently used are generally tubular channels of aluminum or some other metal containing a desiccant to keep the sealed air space dry.

A significant problem arises because the metal spacer is a much better heat conductor than the surrounding air space. This leads to the conduction of heat from the inside glass plate to the outside glass plate from where it is dissipated into the atmosphere. Further, there can result a differential dimensional change between the glass and the spacer causing stress to develop on the glass and on the seal which can result in damage to and the failure of the sealed glass unit.

There have been some attempts to use spacers made of polyvinyl chloride* rather than metal. This has, however, been unsuccessful because the sealants which have been developed to construct reliable units bond well to glass and metal spacers but not to polyvinyl chloride spacers; this leads to structural weaknesses in units constructed with PVC spacers. Furthermore, the differential dimensional change that occurs between glass and PVC spacers over a certain range of temperature is much higher than with a metal spacer. In addition, most plastics have been found unacceptable for use between glass panes because they give off volatile materials, e.g. plasticizers, which cloud or fog the interior glass surface.

* See "Factory-Sealed Double-Glazing Units," Solvason et al, *Canadian Building Digest,* October, 1963.

The prior art does show some examples of the use of plastic over another core material, but the details of construction and environment differ entirely from the present invention. U.S. Pat. No. 3,694,985, for example, shows a wooden mullion element covered with a plastic extrusion, but this is not a spacer for double insulated glass. U.S. Pat. No. 3,070,854 shows a plastic channel member provided to cover a wooden separator between a pair of glass panes and U.S. Pat. No. 2,239,517 shows a metal separator provided with a plastic coating used in window construction. Again, the details of these devices are totally different than the present invention.

My own U.S. Pat. No. 3,918,231 shows an extruded plastic element for fitting over a metallic frame element. Also, my own U.S. Pat. No. 3,442,059 shows the use of a plastic spacer in the form of strips which fix into grooves provided in extruded metal holders for window panes, but this does not suggest the provision of a spacer having such plastic elements interposed between it and the window pane. Finally, U.S. Pat. No. 3,455,080 also shown plastic strips for holding window panes.

As indicated above, none of these prior patents is concerned with the particular problems of double insulated glass and none provides a solution to these problems.

SUMMARY OF THE INVENTION

It is, accordingly, an object of the present invention to overcome the deficiencies of the prior art, such as indicated above.

It is another object of the present Invention to provide for improved double insulated glass.

It is a further object to reduce heat transfer from one pane of glass to the other through the spacer element of double insulated glass.

The present invention utilizes an improved spacer element which combines the structural advantages of metal spacers with a plastic insulating element which reduces heat transfer. Because presently used sealants have proven strong and long-term adherent properties to glass and to metal but not to plastics, the present invention incorporates a metal spacer having portions for contacting the sealant to provide a solid bond between the glass plate and the metal spacer. The spacer may be the conventional extruded aluminum spacer having inwardly sloping portions along the sealing edge to form spaces which are filled with the sealant. However, the present invention incorporates one or more plastic insulator elements, preferably extruded, to prevent any direct glass to metal spacer contact and further to provide only minimum contact with the glass plate so that a poor heat conduction path between the plates is formed while functioning as a spacer to keep the two glass plates a precise distance apart during construction of the sealed unit.

BRIEF DESCRIPTION OF THE DRAWINGS

The invention and its further objects and advantages will be better understood from the following detailed description of various embodiments, cited for the sake of illustration with reference to the accompanying drawings in which.

DETAILED DESCRIPTION OF EMBODIMENTS

The preferred embodiment of the present invention is an extruded plastic insulator which fits over a conventional metal spacer. The insulator element is actually constructed of two separate halves which independently attach to the metal spacer and are held mechanically affixed by contact pressure or friction. The two halves make minimal contact with each other along a serrated edge at the inside center of the spacer above a slot in the aluminum spacer through which the desiccant inside the aluminum spacer can communicate with the air space between the glass panes. Each edge of the insulator element which lies along the edge of the aluminum spacer for contact with the glass pane has at least one narrow projecting contact edge extending generally perpendicular to the plane of the glass panes, which is the actual contact between the spacer and the glass. Two such projecting contacts provide better allignment stability but since the four spacers forming the four sides of the sealed unit are joined together before construction, one contact on each edge is sufficient. Variations in the widths of these contact projections determine the total width of the gap between the glass panes.

Another embodiment of the improved spacer consists of an extruded or roll-formed spacer element with keyhole shaped grooves along the sides to form retainers for plastic insulating strips also having narrow portions extending generally perpendicular to the plane of the glass panes, which will form the contacts between the spacers and the glass panes. The plastic strips are anchored by a dove-tail like construction but fit somewhat loosely in the grooves to allow for independent longitudinal expansion and contraction. Further, the plastic strips may be of short length compared to the total length of the spacer element to prevent any bi-metal effect caused by the different coefficients of expansion between the plastic and the metal element. Again, these plastic elements can be of various heights to confrom overall width of the spacer to the desired width of space between the glass panes. Although this latter design uses less plastic material, the more complex shape of the metal spacer makes the first described embodiment preferable.

The plastic insulating elements are formed of and extrudable thermoplastic resin which gives off no volatile components and yet combines the advantages of heat resistance, dimensional stability, low moisture absorption and excellent processability. A polymer meeting these requirements is polyphenylene oxide, sold by G. E. under the name Noryl. PVC, on the other hand, and most other plastics as well, have not been found suitable because they cause fogging of the glass.

Figure 1:
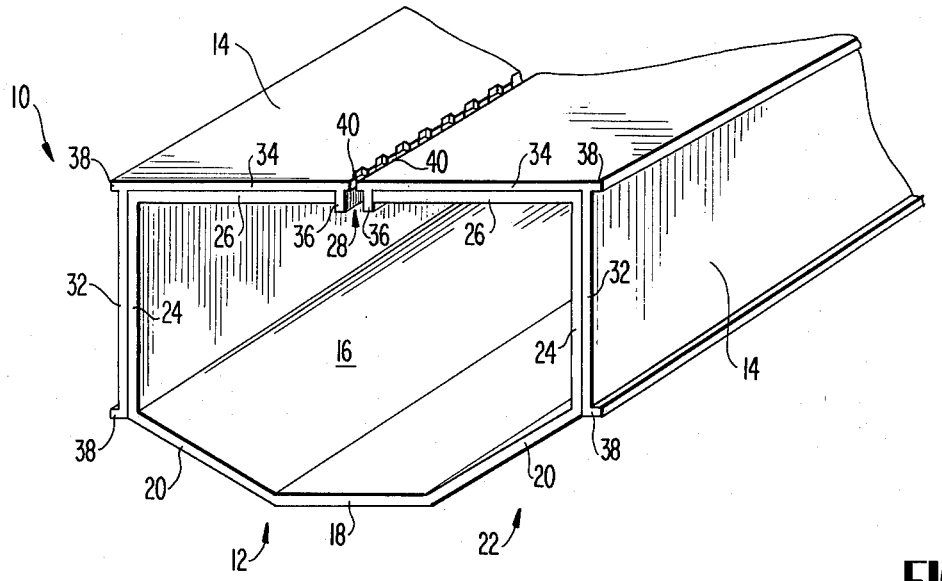
FIG. 1 shows an end perspective view of an embodiment of the invention in which a conventional metal spacer is provided with an extruded plastic insulator mounted to it.

The improved insulating spacer 10 as shown in FIG. 1 comprises a commonly used metal spacer 12 of extruded or roll-formed aluminum or steel and a pair of extruded plastic insulators 14 which fit over the metal spacer 12. The metal spacer 12 forms a hollow channel 16 which is defined by an outer wall 18 which forms part of the edge of the sealed glass unit, sloped sealing walls 20 which form a space with the glass plate in which a sealant* is applied to bond the units together, lateral walls which are parallel or generally parallel to the panes of glass, and inside walls 26; a slot 28 runs the length of the spacer between the ends of walls 26 and allows a desiccant placed in the channel 16 of the spacer to be in gaseous contact with the air space between the sealed glass panes.

* Conventional sealants may be used in the present invention. A number of these are disclosed in "Sealants for Insulating-Glass Units", Strecker, *Adhesives Age,* November, 1975, hereby incorporated by reference.

The plastic insulators 14 constitute a pair of generally symmetrical elements each of which comprises a lateral side 32 which parallels the glass plate, an inner side 34 and an attachment flange 36 which frictionally holds the plastic Insulator section to the metal spacer. Attachment flange 36 extends into the slot 28 of the metal spacer 12 in contact with the edge of the wall 26 thereof, while side 32 contacts the wall 24 of the metal spacer and side 34 contacts the wall 26 of the spacer. The width of the side 34 of the plastic insulating element 14 is such that the fit with the metal spacer is tight and it is held firm by contact forces, i. e. the wall 26 of the spacer 12 is squeezed between the flange 36 and the side 32 of the insulator 14. However, this friction is not so great that longitudinal shrinkage and expansion cannot occur with change in temperature due to different coefficients of expansion of the metal and plastic. If desired, some type of adhesive, e.g. EVA adhesive, could also be used to ensure permanent contact between the elements, although this expedient is not preferred since it introduces the possibility of glass fogging, even though only very small quantities of adhesive are used.

Figure 2:
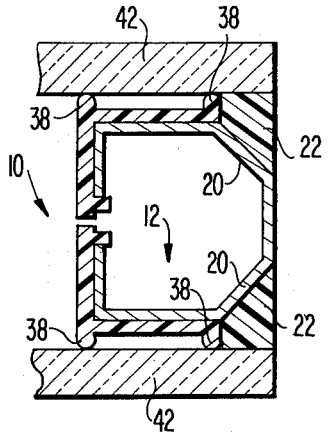
FIG. 2 shown a cross-sectional view of the details of construction of a sealed glass unit with the insulator shown in FIG. 1.

The lateral sides 32 of the plastic insulators each have at least one thin, extended contact flange 38 which projects outwardly from the side 32 for contact with the glass plate 42 (see FIG. 2). The width of these contact flanges 38 is variable and can be selected to provide the desired width between the glass plates. If only one contact projection 38 is provided on each side 32 (e.g., see FIG. 4), then the width of side 32 need not be the full width of the wall 24 of the metal spacer but it can be considerably shortened to save plastic material, since the single contact can be near the side 34. If two contact flanges 38 are provided on each side 32, then they can be positioned at the edges as shown in FIG. 1 or at other points along the side 34 since the position is not critical. It is these thin contact edges 38 which greatly reduce heat transfer between the plates since the plastic is a poor heat conductor and, furthermore, only minimum contact is maintained between the glass plates through the spacer because of the small contact area of the flanges 38. Furthermore, since the contact is minimized, differential dimensional changes due to different expansion coefficients will be of minimum effect and little if any additional stress will be placed on the glass unit.

Additionally the two insulator halves 14 make little contact with each other further reducing the possibility of heat transfer along the spacer. The edges 40 of the surfaces 34 of the insulators, which edges meet at the vicinity of the slot 28, make only minimal contact because one or both are preferably serrated. By providing such serrated edges, exposure of the sealed air space through the slot 28 to the desiccant in the channel 16 in the metal spacer is ensured. The construction of a sealed glass unit is shown in FIG. 2 where the glass plates 42 are separated by the insulating spacer 10. the spaces between the walls 20 and the glass panes 42 have been filled with sealant 22 to bond the unit together and the insulating flanges 38 keep the glass plates 42 in thermal isolation from the metal spacer 12 greatly reducing the heat flow between the plates through the spacer.

Figure 4:
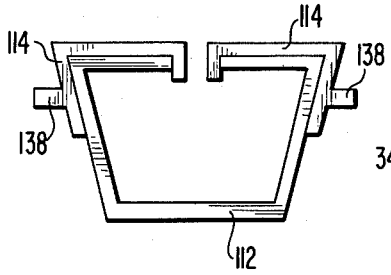
FIGS. 4, 5 and 6 are end views of additional embodiments in accordance with the present invention

Another similar embodiment is shown in FIG. 4. Here the insulators 114 each have only a single contact flange 138, but the insulators 114 are retained on the metal spacer 112 in the same frictional manner.

Figure 3:
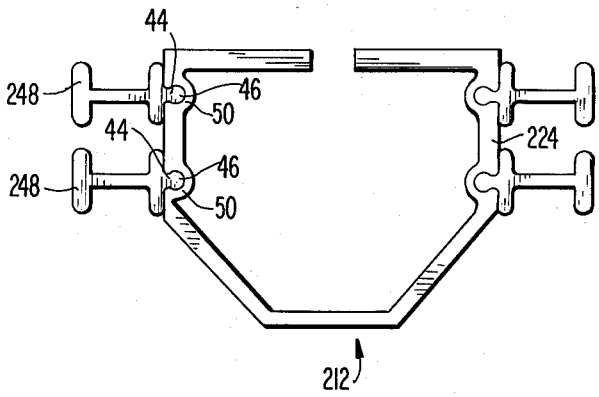
FIG. 3 shows an end view of a second embodiment of a device in accordance with the present invention including a spacer with two grooves and plastic insulating strips on each edge.

A further embodiment of the invention as shown in FIG. 3 comprises a metal spacer 212 of design similar to FIGS. 1 and 2 embodiment above with the addition of a pair of grooves 44 opening into elongated sockets 46 along each surface 224 of the metal spacer 212. Into each groove 44 and socket 46 there is dovetailed a plastic insulating strip 248 of cross-sectional configuration as shown; these shapes are not critical noting FIGS. 5 and 6 which show variations. However, each strip 248 has an elongated and enlarged flange 50 which is complementary to and fits within the keyhole shaped groove 44–46. This arrangement allows limited movement of the plastic insulating insert 248 to avoid effects of differential expansion due to different coefficients of expansion. The width of the plastic insulating insert 248 or the distance that it extends from the surface 224 of the metal spacer 212 is variable and can be chosen for whatever gap between the glass plates may be desired. In addition, the length of the inserts 248 may be short compared to the length of the metal spacer 212 to avoid problems of different coefficients of expansion. This configuration also provides good thermal insulation between the two glass plates through the spacer element.

Figure 5:
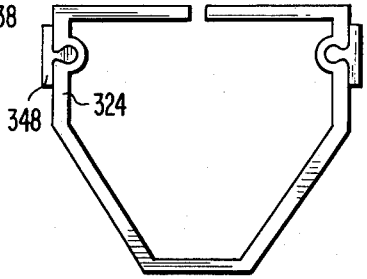
Figure 6:
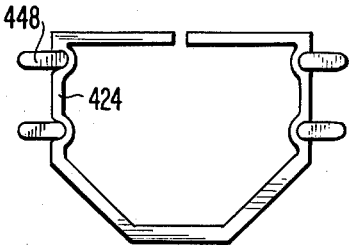

FIGS. 5 and 6 shows variations of the FIG. 3 construction. In FIG. 5 only one insulation strip 348 is provided in each wall 324. Such strip may be provided with a flat surface for abutment against the glass pane. In FIG. 6, a pair of insulating strips 448 are provided for each wall 424, but in this embodiment, the strips 448 are flat. Of course, it will be understood that variations are possible, e.g., strips of configuration of those in FIG. 6 could be used in the FIG. 5 embodiment and vice versa.

The advantages of the combined spacer are the reduced heat transfer characteristics from the use of the plastic insulator and the structural rigidity from the continued use of the metal spacer. Since the overall width of the sealed glass unit can be adjusted by varying the width of the plastic insulator only one standard size of the aluminum spacer need to used in combination with various plastic insulators which are easily made in various sizes.

Of course, other embodiments and adaptations may be provided without going beyond the scope of the invention. It will be obvious to those skilled in the art that various changes may be made without departing from the scope of the invention and the invention is not to be considered limited to what is described in the specification. For example, a single insulator having holes therein over the slot 28, could be used in place of the pair shown in FIGS. 1, 2 and 4, although this increases heat transfer slightly.

What is claimed is:

1. An insulating spacer for precision separation of plates in double insulated glass, comprising:

a metal spacer for interposition between two glass panes, said metal spacer permitting conventional sealant bonding of the glass to the spacer, said metal spacer having a slot running the length thereof; and insulating means attached to said metal spacer to thermally isolate said metal spacer from the two panes of glass, thereby greatly reducing the heat transfer from one pane of glass to the other through the spacer, said insulating means comprising an elongated plastic element formed of two symmetrical sections, each fitting tightly to a portion of said metal spacer so that each is fixedly held to the metal spacer, and each correspondingly covering at least a portion of one of the two sides of the spacer which contact the glass plates, said two symmetrical sections of said insulator making minimal contact with each other, said sections being separated adjacent the slot of said metal spacer.

2. An insulating spacer as claimed in claim 1, wherein said plastic insulator is made of extruded polyphenylene oxide.

3. An insulating spacer as claimed in claim 1, wherein at least one of said two symmetrical sections has a serrated edge which runs along the center of the interior surface of the spacer the length of the spacer adjacent to the corresponding edge of the other section.

4. An insulating spacer as claimed in claim 1, wherein each said insulator section has at least one projecting contact edge extending the length of he insulator, said contact edge located along the surface of the insulator which contact a glass plate.

5. An insulating spacer as claimed in claim 3, wherein each said plastic insulator section has at least one projecting contact edge running the length of the spacer, each being located on one of the two sides of the spacer which contact the glass plates.

6. In double insulated glass comprising a pair of separated glass panes, an air space therebetween, a metallic separator between said glass panes about their periphery, and a plastomeric or elastomeric sealant bonding said metallic separator to said glass panes and sealing the air space therebetween, the improvement comprising:

means to reduce heat transfer from one glass pane to the other through said metallic separator, said heat transfer reducing means comprising an elongated, self-supporting thermoplastic insulating strip interposed between said metallic separator and at least one of said glass panes to thermally isolate said metallic separator from said glass pane, said insulating strip being formed of a thermoplastic material which does not give off any volatile material, said insulating strip fitting tightly over and frictionally grasping said metallic separator so that it is fixedly held thereto and covers at least a portion of the two sides of the separator so as to lie between said glass panes and said separator walls.

7. Double insulated glass in accordance with claim 6, wherein said metallic spacer is hollow and has an opening between the air space and the hollow of said spacer, a dessicant within the hollow of said spacer, and wherein said elongated insulating strip comprises two sections, each interposed between said metallic separator and one of said glass panes, with a gap between the two insulating strips so that the opening between the air space and the hollow of said spacer is not blocked.

8. Double insulating glass in accordance with claim 7, wherein said spacer is provided with longitudinal grooves within which said strips are retained.

9. Double insulated glass in accordance with claim 7, wherein said strips are removably fitted to said metallic spacer whereby said strips are free to shrink or expand longitudinally relative to said metallic spacer with changes in temperature, and whereby the width of said strips can be selected for a desired spacing between said glass panes using a said metallic spacer of standarized size.

10. Double insulated glass in accordance with claim 9, wherein each said strip has a narrow portion extending generally perpendicular to the plane of said glass panes.

* * * * *